US005850950A

United States Patent [19]

Hofmann

[11] Patent Number: 5,850,950

[45] Date of Patent: Dec. 22, 1998

[54] CONTAINER FOR DISPENSING POWDERED GRANULAR OR FLAKED SUBSTANCES

[75] Inventor: Richard W. Hofmann, Chicago, Ill.

[73] Assignee: Magenta Corporation, Chicago, Ill.

[21] Appl. No.: 854,286

[22] Filed: May 9, 1997

[51] Int. Cl.[6] ..... B65D 41/04; B65D 47/00

[52] U.S. Cl. ..... 222/519; 222/549; 222/553; 222/565

[58] Field of Search ..... 222/519, 520, 222/549, 553, 565, 480

[56] References Cited

U.S. PATENT DOCUMENTS

| | | | |
|---|---|---|---|
| D. 60,206 | 1/1922 | Abbott . | |
| D. 108,942 | 3/1938 | Gravem . | |
| D. 152,601 | 2/1949 | Dillon . | |
| 165,670 | 7/1875 | Goodwin et al. | 222/553 |
| D. 367,207 | 2/1996 | Lutzker . | |
| 903,399 | 11/1908 | Nixon et al. . | |
| 997,060 | 7/1911 | Hedrich . | |
| 1,714,368 | 5/1929 | Hobson | 222/553 |
| 2,514,416 | 7/1950 | Plunkett . | |
| 2,805,800 | 9/1957 | Malick et al. | 222/519 |
| 2,860,821 | 11/1958 | Hartung et al. | 222/519 |
| 3,067,916 | 12/1962 | Lerner | 222/519 |
| 3,168,969 | 2/1965 | Krieps | 222/520 |
| 3,261,513 | 7/1966 | Moran | 222/553 X |
| 3,471,066 | 10/1969 | Micallef | 222/519 |
| 3,542,258 | 11/1970 | Marchant | 222/520 |
| 4,023,714 | 5/1977 | Klemek . | |
| 4,191,315 | 3/1980 | Funke | 222/553 |
| 4,544,063 | 10/1985 | Neward | 222/519 X |
| 4,784,288 | 11/1988 | Jennings . | |
| 4,930,688 | 6/1990 | Arona-Delonghi | 222/549 X |
| 4,961,515 | 10/1990 | Schreiber | 222/553 X |
| 4,971,203 | 11/1990 | Weinstein . | |
| 5,110,017 | 5/1992 | Braun | 222/549 X |
| 5,111,967 | 5/1992 | Schreiber | 222/549 X |
| 5,284,273 | 2/1994 | Schreiber | 222/553 X |
| 5,379,922 | 1/1995 | Paradoski . | |

FOREIGN PATENT DOCUMENTS

| | | | |
|---|---|---|---|
| 2627461 | 8/1989 | France | 222/519 |

*Primary Examiner*—Kevin P. Shaver

*Attorney, Agent, or Firm*—Laff, Whitesel, Conte & Saret, Ltd.; Robert F. I. Conte

[57] ABSTRACT

A container for dispensing granular, flaked or powdered substances. The container has a container body, an adapter or neck, and a closure. The adapter is a hollow tube and has an adapter end connected to the container body. The adapter has an open end opposite the adapter end connected to the container body. The closure is adjustably coupled to the adapter at the adapter open end. The closure has a plurality of apertures in its closure wall. The closure is adjustable along an axis of the adapter by rotating the closure. The closure can be rotated to adjust the closure to an open position so that the apertures in the closure are at least partially unobstructed by the adapter and form a passageway into an interior hollow of the container. The closure can be rotated to adjust the closure to a closed position so that the closure apertures are completely obstructed by the adapter. Rotation of the closure changes the axial length of the container so that the axial length of the container is greater when the closure is in the open position than when the closure is in the closed position. The closure when in the closed position tightly seals the container.

8 Claims, 6 Drawing Sheets

CONTAINER FOR DISPENSING POWDERED GRANULAR OR FLAKED SUBSTANCES

FIELD OF INVENTION

The invention relates to a container and more particularly to a container for dispensing powdered, granular or flaked substances.

BACKGROUND

Industry has come up with containers of numerous shapes and sizes for use in dispensing granular, flaked or powdered substances. A typical container has apertures opening into the interior of the container. The apertures in the container allow for dispensing of the substance in the container.

Plunkett, U.S. Pat. No. 2,514,416, discloses a way industry controls the dispensing of dry condiments. Plunkett provides a container having a closure with two distinct dispensing openings. The first dispensing opening is a plurality of small apertures. The second dispensing opening is a single large aperture. The user selects the appropriate dispensing opening by positioning the closure so that the appropriate dispensing opening is aligned with an opening in the container body.

Paradoski, U.S. Pat. No. 5,379,922, discloses another way industry controls the dispensing of dry condiments from a container. Paradoski provides a container having a container body with a plurality of dispensing openings. One dispensing opening is a single large aperture. Another dispensing opening consists of a plurality of small apertures. The dispensing openings are immediately adjacent to each other. One dispensing opening is vertically above the other dispensing opening. A collar slides along the longitudinal axis of the container body. A user selects the dispensing opening having the smaller apertures by sliding the collar over the dispensing opening having the large aperture. The user selects the large opening by sliding the collar below both the large and small openings.

The previous containers have problems. The movable closures do not provide a very tight seal with the container body. Thus, the substances inside lose their freshness. Industry has tried to solve the freshness problem by providing apertures which are stationarily affixed to the container body. A closure is disposed over the apertures. The closure is either snap-fit over, screwed over, or taped over the apertures. The closure seals the container. A problem with this approach is that the closure often becomes misplaced. A further problem is that the closure is often placed in debris and requires frequent cleaning.

Another problem with the previous containers is that they often become clogged. Unclogging requires the user to clean the apertures. Cleaning apertures which are disposed in the container body can result in debris falling inside the container, causing the substance in the container to become contaminated.

It is a desire of the present invention to provide a container having a closure with apertures. The closure is coupled to the container. The closure is adjustable along an axis of the container in a first axial direction by rotation of the closure in a first rotational direction and adjustable along the axis in a second opposite axial direction by rotation of the container in a second rotational direction.

It is a further desire of the invention that the closure can be adjusted in the first axial direction to an open position; in the open position the closure apertures are at least partially unobstructed to provide a passage to an interior hollow of the container.

It is a further desire of the invention that the closure can be adjusted in the second axial direction to a closed position; in the closed position the apertures are completely obstructed.

It is another desire of the invention that the closure, when in the closed position, tightly seal the container.

SUMMARY

Accordingly, the container for dispensing granular, flaked or powdered substances has a container body. The container body has a closed end. The container body has an end opposite the closed end. The end opposite is sized to receive an adapter. The container body has an interior surface defining a hollow.

The container includes an adapter having an adapter end connected to the container body end sized to receive an adapter. The adapter has an adapter open end. The adapter open end is opposite the adapter end connected to the container body. The adapter has an adapter exterior surface and an adapter interior surface. The adapter interior surface defines a hollow. The container body hollow and adapter hollow are continuous and form an interior hollow of the container.

The container also includes a closure adjustably coupled to the adapter. The closure has a closure wall. The closure wall has a plurality of apertures. The closure has a closure open end at one end of the wall. The closure has a closure top opposite the closure open end. The top covers the adapter open end.

The container also includes means for adjusting the closure relative to the adapter in a first axial direction along an axis of the adapter, and for adjusting the closure in a second axial direction opposite to the first axial direction. Adjustment in the first axial direction causes an increase in an axial length of the container. Adjustment in the second axial direction causes a decrease in the axial length of the container.

The closure is adjustable to an open position wherein the closure's apertures are at least partially unobstructed by the adapter. The closure is also adjustable to a closed position wherein the apertures are completely obstructed by the adapter. The axial length of the container when the closure is in an open position is greater than the axial length of the container when the closure is in a closed position.

The container can still be further characterized in that the means for adjusting the closure includes means for rotating said closure relative to the adapter in a first rotational direction and means for rotating the closure relative to the adapter in a second rotational direction opposite the first rotational direction. Rotation in the first rotational direction adjusts the closure in the first axial direction and rotation in the second rotational direction adjusts the closure in the second axial direction.

The container is further characterized in that the means for adjusting said closure includes an adapter guide forming part of the adapter. The means also includes a closure guide forming part of the closure wall. The closure guide operatively fits with the adapter guide.

The container is still further characterized in that it includes means for sealing the closure to the adapter. The means for sealing includes a closure interior wall forming part of the closure. A chasm separates the closure interior wall and the closure wall. When the closure is in its closed position a portion of the adapter is disposed in the chasm.

The container can still further be characterized in that the adapter end connected to the container body is integral with the container body and forms the neck of the container body.

The above and other desires, benefits, objects and features of the invention are further illustrated by reference to the figures and the detailed description.

Figures

Detailed Description

Figure 1:
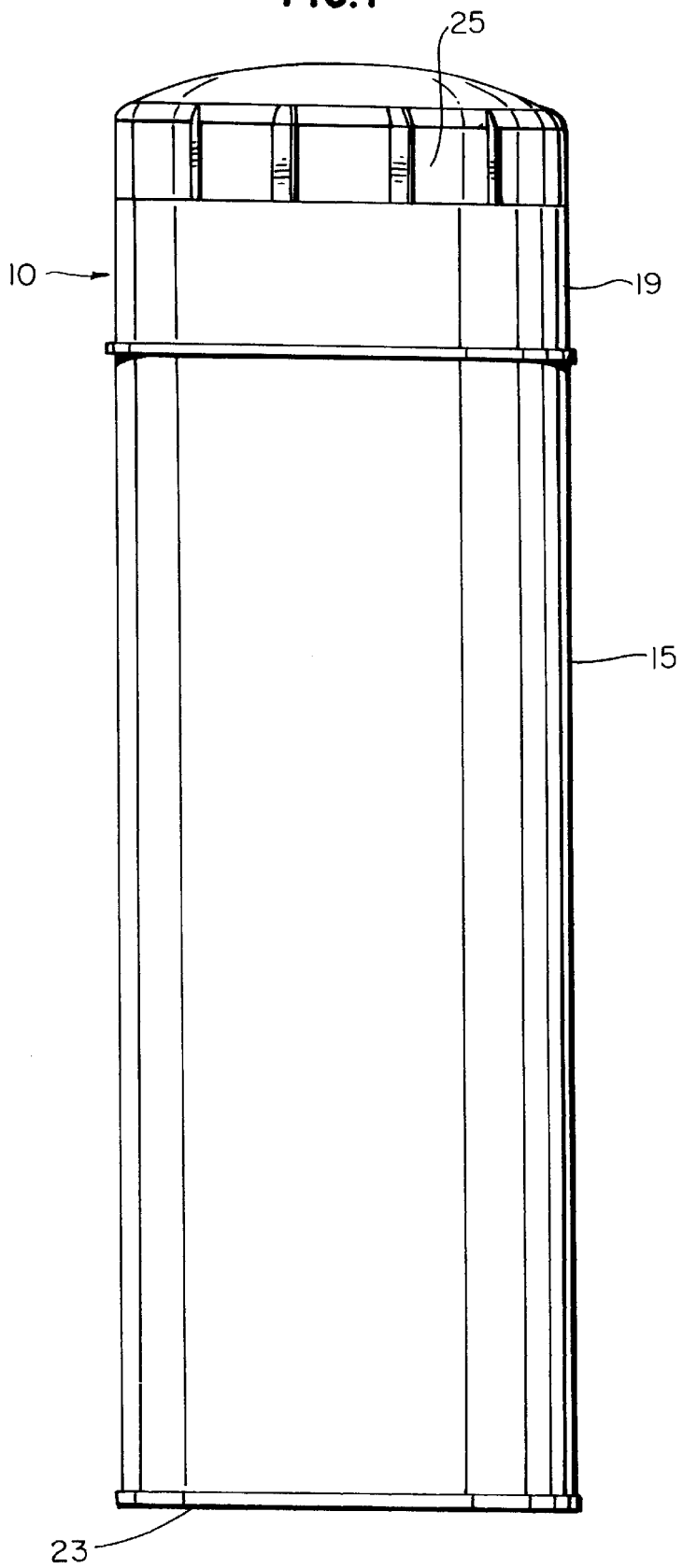
FIG. 1 is a side perspective view of a first embodiment of the container with its closure in the closed position.

FIGS. 1–4 show an example of the container. The container (10) includes a container body (15), an adapter (17), and a closure (19). The adapter (17) is hollow and is permanently and fixedly coupled to the container body (15). The closure (19) is permanently and adjustably coupled to the adapter (17).

In more detail, the container body (15) has a container body interior surface (21) defining a hollow. The container body (15) has a container body closed end (23). Opposite the container body closed end (23) is the adapter (17), which is permanently and fixedly coupled to the container body (15).

The adapter (17) has a tubular shape. The adapter (17) has an adapter exterior surface (25), an adapter interior surface (27) defining an adapter hollow, an adapter end (29) which couples to the container body (15), and an adapter open end (31) which is covered by the closure (19). The adapter hollow and container body hollow define the continuous interior hollow of the container.

The closure (19) has a closure wall (33). The closure wall (33) is annular. At one end of the wall is a closure top (35). At an opposite end of the wall is a closure open end (37). The closure open end (37) fits over the adapter open end (31). The closure wall (33) is disposed around the adapter exterior surface (25). The closure wall interior surface (38) is adjacent to the adapter exterior surface (25). The closure wall (33) has a plurality of apertures (39). The apertures have an outer edge **(39*a*). A portion of the outer edge (39*b*) is radially inward and forms a notched area (39*c*). The closure top (35) is integral with the closure wall (33)** and is dome-shaped.

The closure (19) is adjustable relative to the adapter (17). The closure (19) can be positioned at various places along the adapter's axis (41). Movement of the closure (19) in a first axial direction (43) along the adapter's axis (41) results in an increase in the axial length of the container. Movement of the closure (19) in a second axial direction (45) opposite to the first axial direction (43) results in decreasing the axial length of the container.

Figure 3:
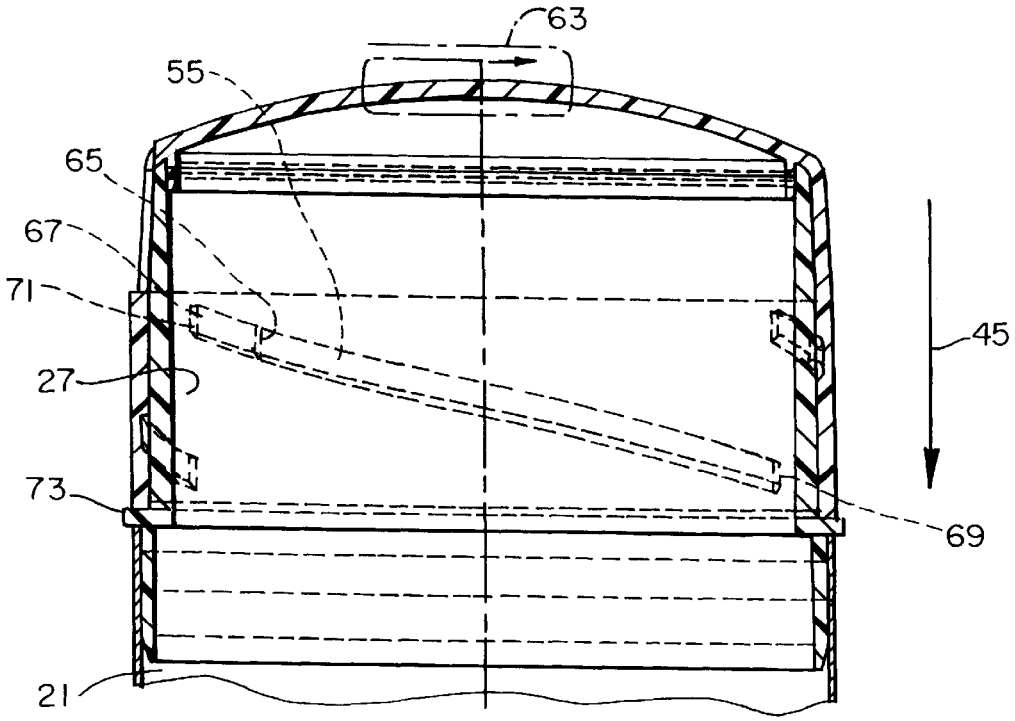
FIG. 3 is a side cross-sectional view of the first embodiment showing the closure coupled to the adapter in the closed position.

The closure (19), when positioned in an open position (FIG. 4), is positioned along the adapter's axis (41) so that the container's axial length is greater than when the closure (19) is in a closed position (FIG. 3 and FIG. 1). In addition, in an open position (FIG. 4) the apertures (39) are at least partially unobstructed by the adapter exterior surface (25) so as to provide a passage into the interior hollow of the container.

Figure 4:
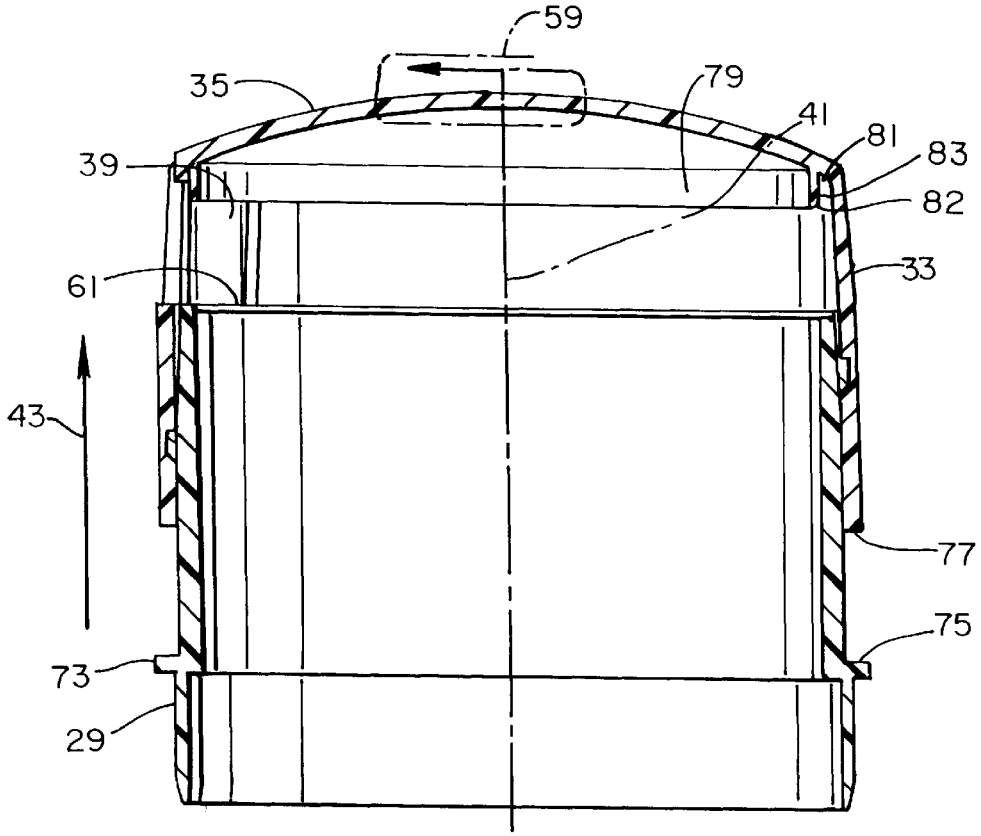
FIG. 4 is a side cross-sectional view of the first embodiment showing the closure coupled to the adapter in the open position.

The closure (19), when positioned in the closed position (FIG. 3, FIG. 1), is positioned along the adapter axis (41) so that the container's axial length is shorter than when the closure (19) is in the open position (FIG. 4). In addition, the apertures (39) are completely obstructed by the adapter exterior surface (25).

Figure 2:
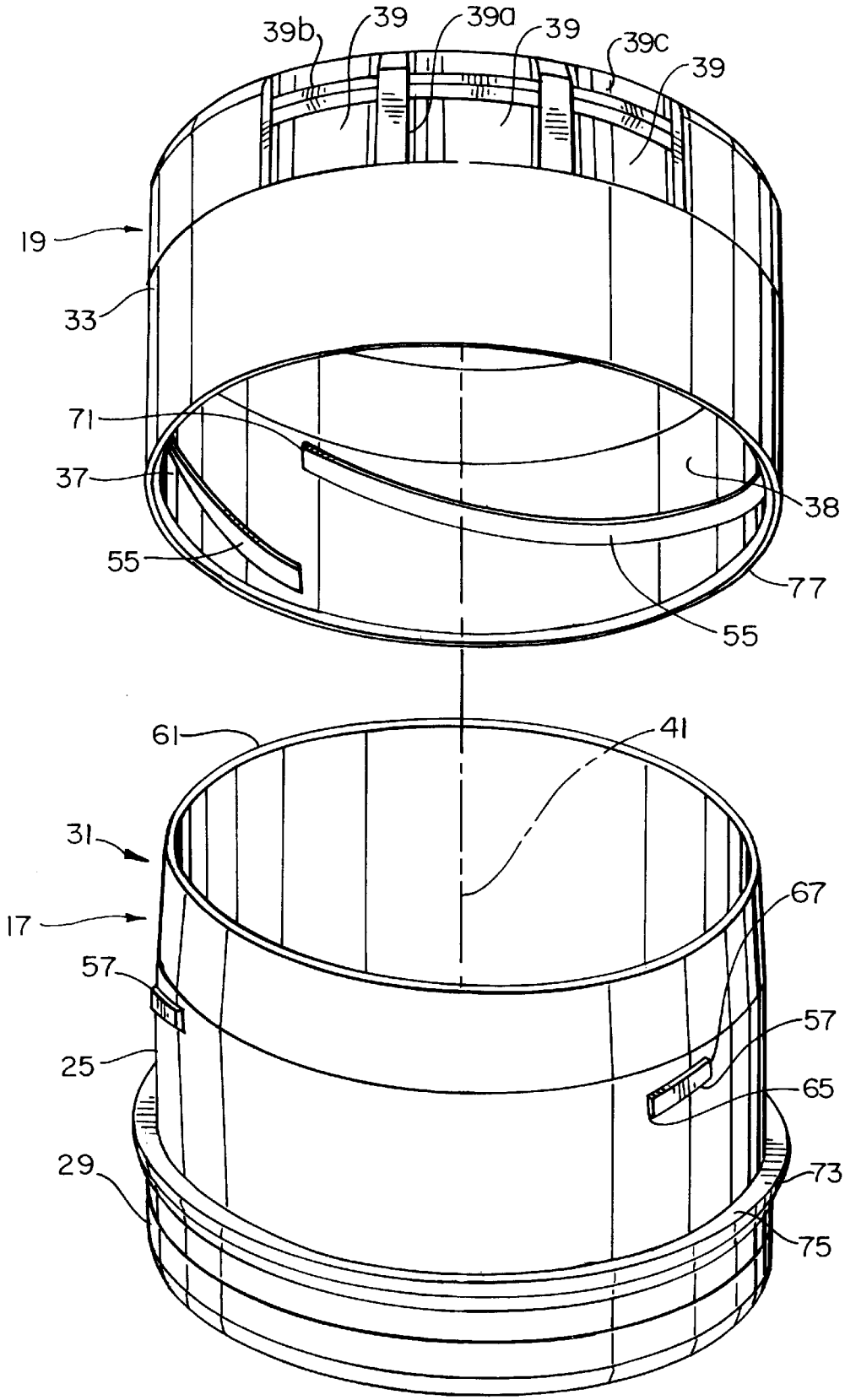
FIG. 2 is an exploded side perspective view of the first embodiment of the closure and adapter.

Referring to FIGS. 2 and 3, the adjustment of the closure (19) along the adapter axis (41) is accomplished by rotating the closure (19) relative to the adapter (17). Guides (55, 57) in the adapter and closure direct the rotation and axial movement. The adapter guide (57) is along the adapter exterior surface (25). The closure guide (55) is along the closure wall interior surface (38). The closure guide (55) operatively fits with the adapter guide (57).

The closure guide (55) is formed by a plurality of grooves (55). Each groove (55) has a gradient upwardly sloping from the closure open end (37) towards the closure top (35). The adapter guide (57) is formed by a plurality of projections (57). The closure (19) is permanently and rotatably coupled to the adapter (17) by the disposition of the projections (57) inside the grooves (55). The corresponding grooves (55) and projections (57) are helical.

Rotation of the closure (19) relative to the adapter (17) in a first rotational direction (59) causes the closure (19) to move in the first axial direction and towards the open position. In the open position, the closure apertures (39) are at least partially above an adapter end surface (61) at the adapter open end (31). Rotating the closure (19) relative to the adapter (17) in an opposite second rotational direction (63) causes the closure to move in the second axial direction towards the closed position. In the closed position the apertures (39) are below the adapter end surface (61) at the adapter open end (31).

By rotating the closure (19) relative to the adapter (17), a user can select a multitude of intermediate positions. In intermediate positions, the closure apertures (39) are less obstructed than in the closed position and more obstructed than in the open position. There is enough frictional contact between the closure (19) and the adapter (17) to maintain the closure (19) in a selected position until the user rotates the closure (19) relative to the adapter (17).

The interaction of the projections (57) and grooves (55) sets the closure (19) in the open position. Each projection (57) has a projection first end (65) and an opposite projection second end (67). Each groove (55) has a groove first end (69) and an opposite groove second end (71). In the closure open position each projection first end (65) abuts up against a corresponding groove first end (69). At the point of abutment the closure (19) is in the open position.

FIGS. 3 and 4 show how the adapter (17) provides an axial stop for the closure (19). The adapter (17) has a collar (73). The collar (73) is annular. The collar (73) encircles the adapter exterior surface (25). The collar (73) forms a ledge having a ledge surface (75) facing towards the adapter open end (31). The user, by rotating the closure (19) in the second rotational direction (63), will move the closure (19) in the second axial direction (45), and will cause a closure end surface (77) at the closure open end (37) to abut up against the adapter ledge surface (75). Thus the adapter collar (73) provides an axial stop for the closure.

FIGS. 3 and 4 further show in detail how the closure forms a seal with the adapter. The closure (19) has a closure interior wall (79). The closure interior wall (79) extends away from the closure top (35) and towards the closure open end (37). The interior wall (79) forms an inner annular ring. The closure interior wall (79) is coaxial to the closure wall (33). A chasm (81) separates the closure wall (33) and the closure interior wall (79). The interior wall (79) has an interior wall portion (82) near the interior wall end (83). The portion (82) near the interior wall end has a decreasing outer diameter. The outer diameter decreases in the direction towards the interior wall end (83).

A user, when rotating the closure (19) in the second rotational direction moves the closure in the second axial direction. The movement will cause the adapter end surface (61) to enter into the chasm (81). It will also cause the interior wall (79) to enter into the adapter open end (31) to form a plug seal between the closure and the adapter as shown in FIG. 4.

The interior wall portion (82), by having a decreasing outer diameter, encourages entry of the plug seal (79) into the adapter open end. As shown in FIG. 4, the closure when sealed with the adapter is in the closed position. In the closed position a portion of the adapter interior surface (27) has an interference fit with an outside surface of the interior wall (79). The interference fit ensures a plug seal between the adapter (17) and closure (19).

Referring to FIGS. 2–4, the adapter (17) is glued to the container body with the adapter end (29) inside the container body. The glued fit provides the permanent and fixed coupling of the adapter (17) to the container body (15). The adapter (17) is fixedly coupled to the container body (15) so that the adapter collar (73) tightly abuts up against the container body (15). Also, in some instances, it may be desirable to provide a snap fit between the adapter (17) and the container body (15).

Referring to FIGS. 5–9, we see an alternative embodiment. As can be seen, the embodiment in FIGS. 5–9 is quite similar to the embodiment in FIGS. 1–4. In this embodiment, the adapter (117) is integral with the container body (115); it is a neck (117). The neck (117) has a neck open end (131). The neck (117) has an end surface (185) at the neck open end (131). The neck (117) has neck projections (157) on the neck exterior surface (125). The container body (115) has a ledge (175). The closure (119) has a flat closure top (135). The closure (119) has a closure wall (133). The closure wall (133) is annular. There are five apertures (139) in the closure wall. The apertures have an outer edge (139*a*). A portion of the outer edge (139*b*) is radially inward and forms a notched area (139*c*). The closure (119) has a closure interior wall (179). A chasm (181) separates the closure wall (133) and interior closure wall (179). The closure (119) has closure grooves (155).

Figure 5:
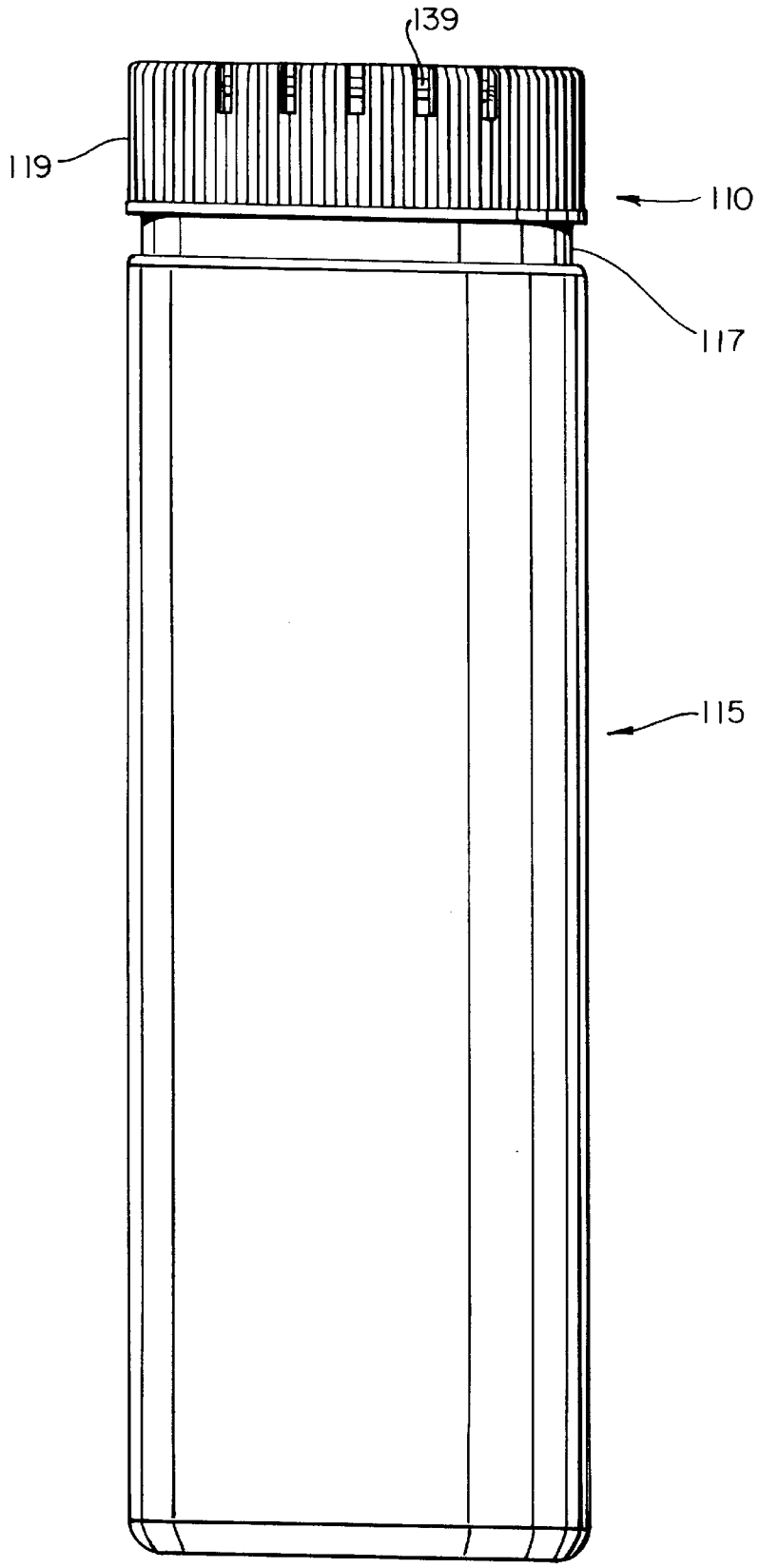
FIG. 5 is a side perspective view of an alternative embodiment of the container with its closure in the open position.
Figure 6:
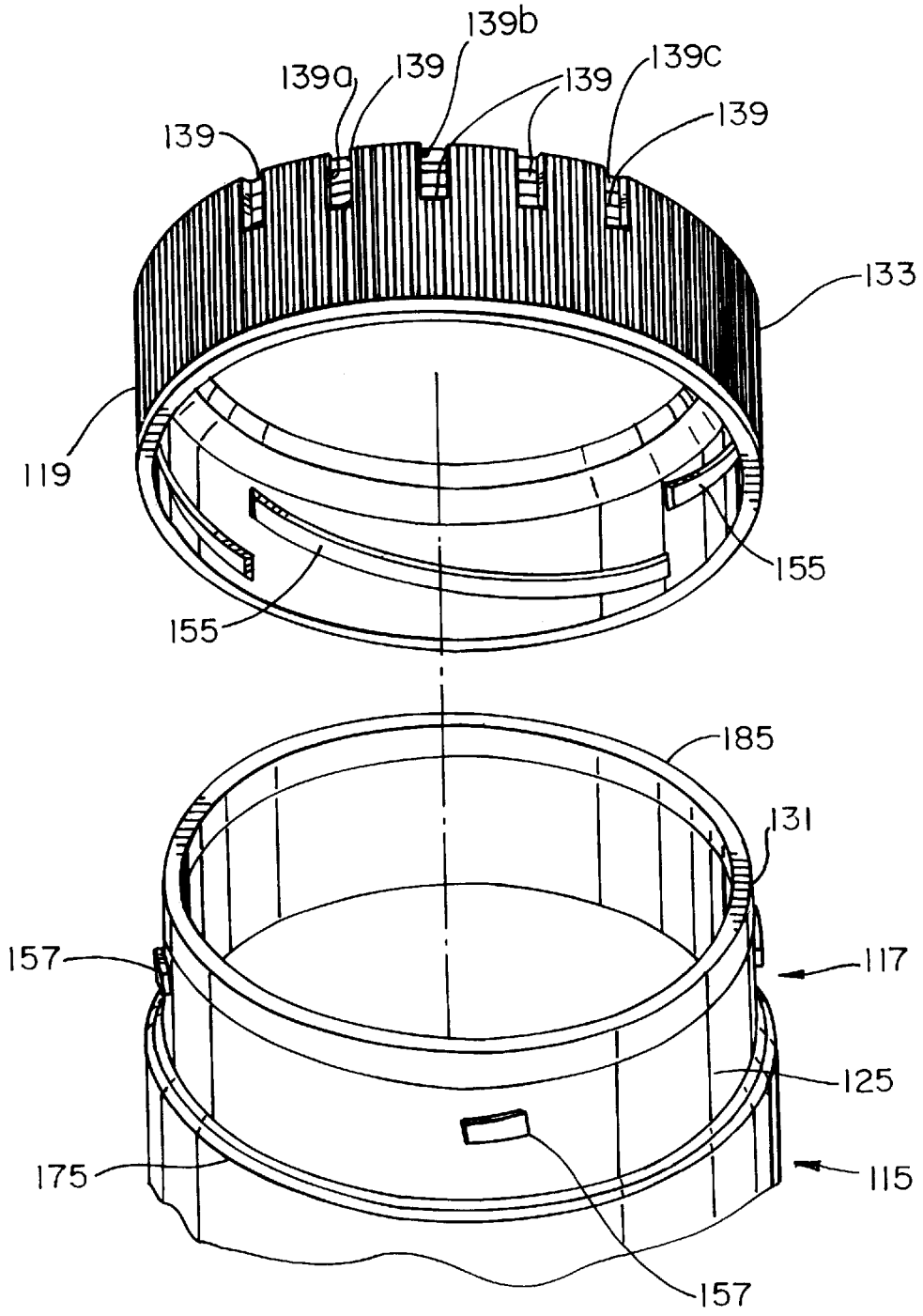
FIG. 6 is an exploded side perspective view of the alternative embodiment showing the closure and adapter; the adapter is integral with the container body.
Figure 7:
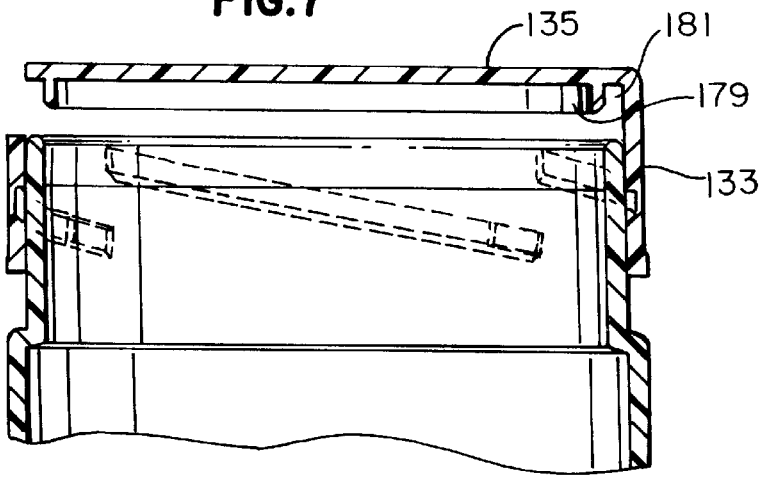
FIG. 7 is a side cross-sectional view of the alternative embodiment showing the closure coupled to the adapter in the open position.
Figure 8:
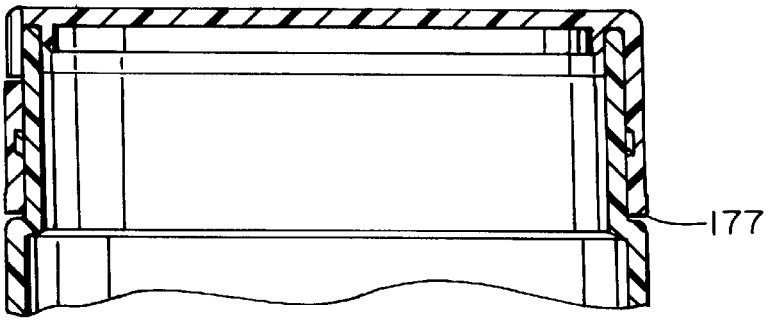
FIG. 8 is a side cross-sectional view of the alternative embodiment of the invention showing the closure coupled to the adapter in the closed position.
Figure 9:
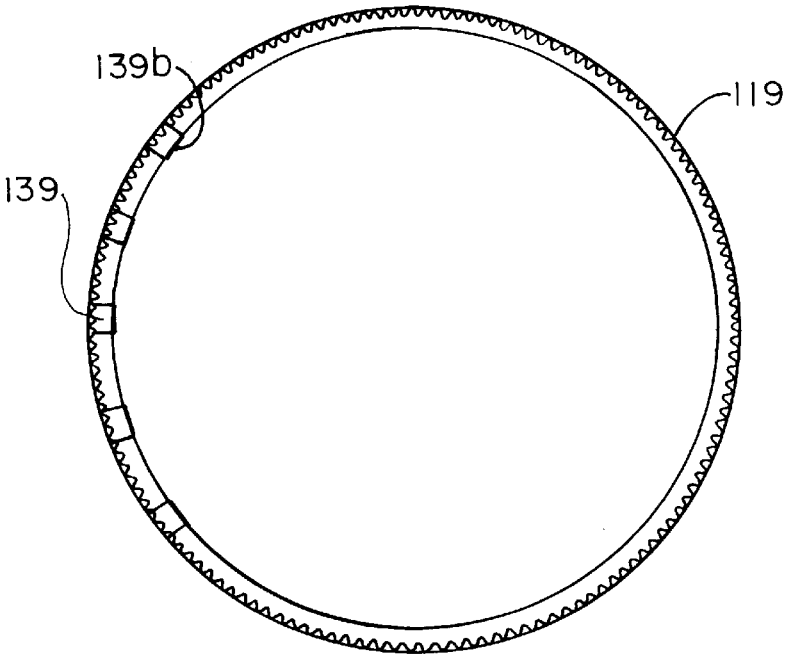
FIG. 9 is a bottom view looking into an open end of the alternative embodiment of the closure.

The closure (119) is permanently and rotatably coupled to the neck (117) by fitting the neck projections (157) in the closure grooves (155). Rotation of the closure (119) moves the closure (119) in a similar fashion as rotation of the closure (19) in FIGS. 3 and 4. Like the previous embodiment, the closure (119) has a closed position (FIG. 8) and an open position (FIG. 5, FIG. 7). In the closed position, however, the closure end surface (177) does not abut against a ledge.

The container in either embodiment can be designed to be refillable. For instance, the container can have a portion such as the adapter, closed end, or another portion designed so that a user can remove the adapter, closed end or other portion to refill the container and then recouple the adapter, closed end or other portion. The other portion could be a plug.

It will, of course, be appreciated that the above-described embodiments of the invention are merely examples, and the invention is not limited to the examples described herein. Obviously, numerous modifications and variations of the present invention are possible in light of the above features. It is therefore understood that various changes and modifications may be effected by one skilled in the art without departing from the scope or spirit of the invention as defined in the appended claims.

I claim:

1. A container for dispensing granular, flaked or powdered substances comprising:

a container body, said container body having a closed end, and an interior surface defining a container body hollow;

an adapter having an adapter end, an adapter open end opposite said adapter end, an adapter exterior surface and an adapter interior surface, said adapter interior surface defining an adapter hollow, said adapter end connected to said container body, said container body hollow and said adapter hollow forming an interior hollow of said container;

a closure adjustably coupled to said adapter, said closure having a closure wall, a closure open end at one end of said wall, and a closure top opposite said closure open end, said closure wall having a plurality of granular, flaked or powdered substance dispensing apertures, said closure top is over said adapter open end;

means for adjusting said closure relative to said adapter in a first axial direction along an axis of said adapter, and for adjusting said closure relative to said adapter in a second axial direction opposite to said first axial direction, wherein adjustment in said first axial direction causes an increase in an axial length of said container and adjustment in said second axial direction causes a decrease in said axial length of said container and wherein;

said closure is adjustable to an open position in which the plurality of apertures are at least partially unobstructed by said adapter and wherein;

said closure is adjustable to a closed position in which the plurality of apertures are completely obstructed by said adapter and wherein;

the axial length of said container when said closure is in an open position is different than the axial length of said container when said closure is in said closed position.

2. The container of claim 1 wherein said closure further comprises:

a plurality of outer edges each defining a mouth of one of said apertures, wherein a portion of each outer edge defines a notched area;

means for rotating said closure relative to said adapter in a first rotational direction and for rotating said closure relative to the adapter in a second rotational direction opposite the first rotational direction, said means for rotating forming part of said means for adjusting, and wherein;

rotation in said first rotational direction adjusts said closure in said first axial direction and rotation in said second rotational direction adjusts said closure in said second axial direction.

3. The container of claim 1 wherein said adapter end connected to said container body is formed integral with said container body, said adapter comprising a neck of said container body.

4. The container of claim 1 wherein said means for adjusting said closure comprises:

a plurality of adapter guides forming a part of said adapter;

a plurality of closure guides forming a part of said closure, said adapter guides operatively coupled to said closure guides;

said plurality of adapter guides and plurality of closure guides selected from the group of guides consisting of a plurality of separate grooves and a plurality of separate projections.

5. The container of claim 1 further comprising means for sealing said closure to said adapter.

6. The container of claim 5 wherein said means for sealing comprises:

a closure interior wall forming part of said closure;

a chasm separating said closure interior wall and said closure wall, wherein when said closure is in said closed position, a portion of said adapter is disposed in said chasm.

7. The container of claim 5 wherein said means for sealing comprises:

a plug seal forming part of said closure, wherein in said closed position, said plug seal is disposed in an open end of the container.

8. A container for dispensing granular, flaked or powdered substances comprising:

a container body, said container body having a closed end, and an interior surface defining a container body hollow;

an adapter having an adapter end, an adapter open end opposite said adapter end, an adapter exterior surface and an adapter interior surface, said adapter interior surface defining an adapter hollow, said adapter end connected to said container body, said container body hollow and said adapter hollow forming an interior hollow of said container;

a closure adjustably coupled to said adapter, said closure having a closure wall, a closure open end at one end of said wall, and a closure top opposite said closure open end, said closure wall having a plurality of granular, flaked or powdered substance dispensing apertures, said closure top is over said adapter open end;

means for adjusting said closure relative to said adapter in a first axial direction along an axis of said adapter, and for adjusting said closure relative to said adapter in a second axial direction opposite to said first axial direction, wherein adjustment in said first axial direction causes an increase in an axial length of said container and adjustment in said second axial direction causes a decrease in said axial length of said container and wherein;

said closure is adjustable to an open position in which the plurality of apertures are at least partially unobstructed by said adapter and wherein;

said closure is adjustable to a closed position in which the plurality of apertures are completely obstructed by said adapter and wherein;

the axial length of said container when said closure is in an open position is different than the axial length of said container when said closure is in said closed position;

said adapter exterior surface tapered radially inward at said adapter open end.

* * * * *